United States Patent [19]

Kaneyasu

[11] 4,223,784

[45] Sep. 23, 1980

[54] LIGHTER WITH CIGARETTE PACKAGE HOLDER PORTION

[75] Inventor: Masao Kaneyasu, Tokyo, Japan

[73] Assignee: Dentsu Central Kabushiki Kaisha, Tokyo, Japan

[21] Appl. No.: 28,910

[22] Filed: Apr. 10, 1979

[51] Int. Cl.[3] ..... F23Q 2/16

[52] U.S. Cl. ..... 206/88; 431/343; 206/236

[58] Field of Search ..... 431/276, 277, 343, 253; 206/85–89

[56] References Cited

U.S. PATENT DOCUMENTS

| | | | |
|---|---|---|---|
| 2,782,910 | 2/1957 | Leibow | 206/87 |
| 3,178,016 | 4/1965 | Coats | 431/353 |

*Primary Examiner*—Carroll B. Dority, Jr.

*Attorney, Agent, or Firm*—Watson, Cole, Grindle & Watson

[57] ABSTRACT

A combined lighter and cigarette package holder device which is useful either by itself as a lighter or as a lighter in combination with a cigarette package, particularly a soft package, which includes arm members attached to a cigarette package holder base member for hinged movement with respect thereto for holding the cigarette package with effective protection for cigarettes contained in the cigarette package. The combined lighter and cigarette package holder device, when used in combination with a cigarette package, permits the smoker to easily take out a cigarette from the cigarette package for smoking, but otherwise act to positively retain cigarettes therein.

10 Claims, 5 Drawing Figures

LIGHTER WITH CIGARETTE PACKAGE HOLDER PORTION

BACKGROUND OF THE INVENTION

Lighters which are used for the lighting up of cigarettes are of course well known, as are lighters which are combined with reusable cigarette casings such that a unitary device is fabricated. However, reusable cigarette casings as such have not been widely accepted by smokers because of the time and trouble required to place the cigarettes therein.

On the other hand, in view of the superior properties of soft packages, such as the prior cigarette packing and the easy formation of an opening in a part of the upper portion through which a cigarette can be easily taken out (although they are inferior in protecting the contained cigarettes as compared to hard packages), they have been widely used, and are being improved due to advancing synthetic resin film techniques which provide improved wrappings used around the packages to improve the moisture-proof characteristics thereof.

OBJECTS OF THE INVENTION

It is an object of the present invention to provide a lighter device which includes a folding cigarette package holder portion such that the lighter device can be used by itself as a lighter or be combined with a cigarette package.

Another object of the present invention is to provide a lighter device with a cigarette package holder portion which, when used in combination with a cigarette package, can easily light up a cigarette.

Another object of the present invention is to provide a lighter device with a cigarette package holder portion which, when combined with a cigarette package, provides effective protection for the cigarette package and prevents the cigarettes contained in the cigarette package from falling out and from being damaged due to external forces.

Still another object of the present invention is to provide a lighter device with a cigarette package holder portion which can be folded up into a small size which is handy enough to carry and use by itself, but can be easily adapted for use in combination with a cigarette package.

SUMMARY OF THE INVENTION

The above objects are accomplished in accordance with the present invention by providing a lighter with a cigarette package holder portion which includes a base member formed in a substantial elongated tetragon shape, the lighter device having a lighter portion formed in a substantial flat parallelopipedon shape and having one of its ridgelines hinged along one side of one surface of the base member, spring means for urging the lighter portion against the base member, arm members hinged along the sides of the other surface of the base member which are perpendicular to the one side thereof connected to the lighter portion, spring means for urging the arm members against the base member, and the lighter portion including a gas ejection nozzle, a flint for igniting the gas ejected through the nozzle, an operation wheel having at least a part projecting from the upper surface of the lighter for rotating a file in sliding contact with the flint, and a valve-opening button normally closing a valve for the nozzle and opening the same when depressed.

The base member and the arm members of the cigarette package holder portion may be formed of metal hard wires bent in a desired elongated tetragon shape or formed of pressed thin metal or molded plastic plates. If the base member is made of a plate, it is formed with an opening in a position corresponding to the opening through which cigarettes are taken out fom the cigarette package, i.e., when the arm members are inserted between the synthetic resin film outer wrapping and the paper inner wrapper of the soft cigarette package so as to combine the cigarette package holder portion integrally with the cigarette package.

Further objects, advantages and features of the invention will become apparent from the arrangement and construction of the constituent parts as depicted in the accompanying drawings and described in the following description.

DETAILED DESCRIPTION OF THE PREFERRED EMBODIMENTS

Figure 1:
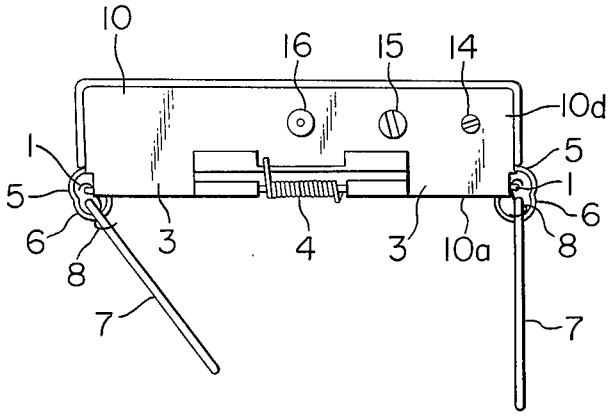
FIG. 1 is a rear view showing one embodiment of a lighter device made in accordance with the present invention with the device shown by itself.

As shown in the figures, the lighter device includes a base member 1 made of a metal wire which is bent in an elongated tetragon shape, and is reinforced by a reinforcing plate 2 which extends between the center portions of the longer sides of the base member 1 which face each other. A flat lighter portion 10 which is contoured to be in substantially parallelopiped shape is hingingly connected along one side of the upper surface of the base member 1 and is urged by a spring member 4 such that its wider side surface 10*a* (see FIG. 3) is placed against the base member 1.

Two couplers 5 are secured along the opposite sides of base member 1 perpendicular to the side of the base member 1, to which the lighter portion 10 is connected, each having a hinge portion 6 to which an arm member 7 is hinged. Each of the arm members 7 is made of a metal hard wire bent in a substantially tetragon shape, and each is urged by a spring member 8 to be folded such that it is positioned adjacent the base member 1. The hinge portions 6 serve to prevent the arm members 7 from rotating substantially over 90° with respect to a plane formed by the base member 1.

Figure 2:
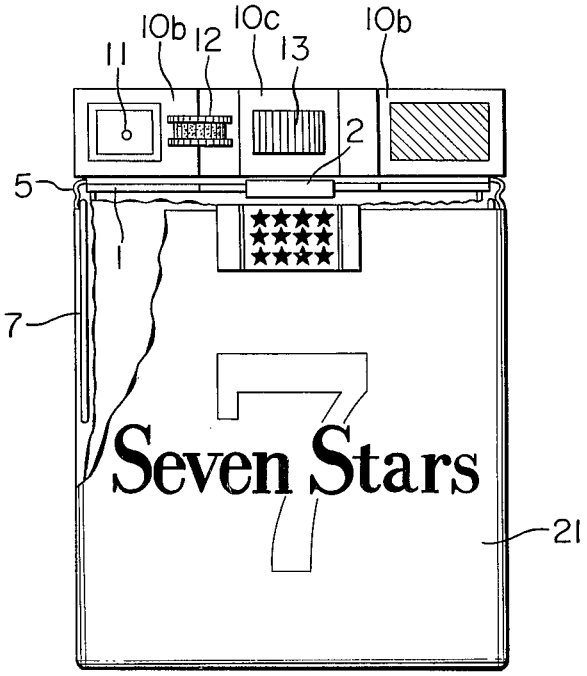
FIG. 2 is a partially broken away front view of the lighter device of FIG. 1 when used in combination with a cigarette package.

As shown in FIG. 2, a gas ejection nozzle 11 and an operation wheel 12 having a file wheel are provided on the side surface 10*b* of the lighter portion 10, and a valve-opening button 13 is provided on the indented surface 10*c* located beneath a plane formed by the surface 10*b* (see FIGS. 3 and 4) for normally closing the nozzle 11 and opening the same when depressed. As shown in FIG. 1, provided on the rear side surface 10*d* of the lighter portion 10 are a valve screw 14 for adjusting the opening of the nozzle 11, a flint replacement screw 15 for a flint 17 (see FIG. 5), and a fuel resupply valve 16.

With the above arrangement, the arm members 7 are folded up and placed adjacent the base member 1 by the force of the spring members 8 so that the lighter device becomes handy to carry when used by itself. When the arm members 7 are unfolded with respect to the base member 1 against the force of the spring members 8 and inserted between the synthetic resin outer wrapper and the paper inner wrapper of a cigarette package 21 so as to hold the inner wrapper of the cigarette package 21 between the arm members 7 and the base member 1, the arm members integrally hold the inner wrapper of the cigarette package 21 under pressure due to the force of the spring members 8, thereby protecting the cigarette package 21 and cigarettes contained therein from damage when carried in a pocket. At this time, the lighter portion 10 is positioned against the base member 1 by the force of the spring member 4 such that it serves to close the opening of the cigarette package and prevent cigarettes from falling out of the package 21.

Figure 3:
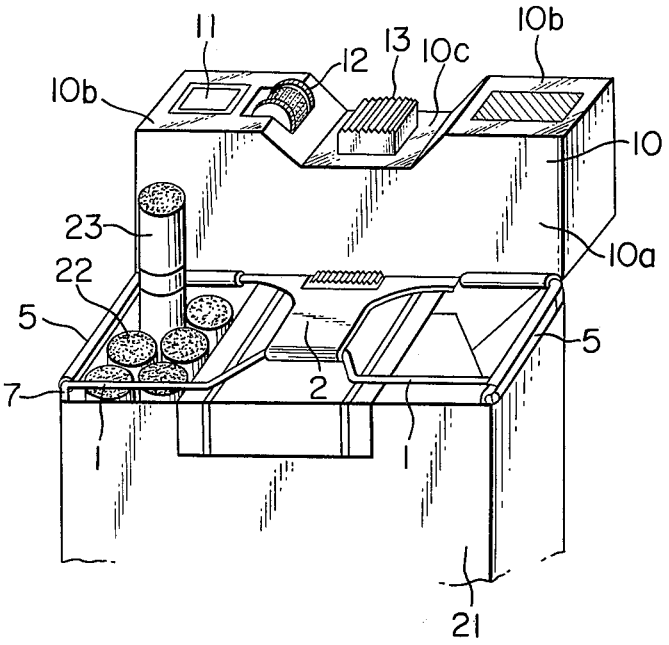
FIG. 3 is a perspective front view of the combined lighter device and cigarette package of FIG. 2 showing the positioning of the elements of the lighter device just before a cigarette is lighted up.

If the smoker desires to have a cigarette, he will rotate the lighter portion 10 against the force of the spring member 4 so as to be perpendicular with respect to the base member and to remove the side surface 10*a* of the lighter 10 from covering the opening 22 of the cigarette package 21 and allow the smoker to take out a cigarette 23 from the cigarette package 21 as shown in FIG. 3. The cigarette 23 may be lit up as is done with normal lighters by the smoker rotating the operation wheel 12 with his finger tip and pushing the valve opening button 13 to ignite the gas ejected through the nozzle 11.

When the smoker releases the lighter portion 10 after lighting up the cigarette 23, the lighter portion 10 will be automatically repositioned against the base member 1 to close the opening 22 of the cigarette package 21 by the force of the spring member 4 so that further cigarettes cannot fall out of the cigarette package 21.

Although the base member 1 and the arm members 7 have been described as being made of metal hard wires which have been bent, they may be made of metal or synthetic resin plates. In this case, the base member should be formed with an opening in a position corresponding to the opening formed in the cigarette package to allow cigarettes 23 to be taken out through the opening from the cigarette package 21.

Although the arm members 7 may be provided on the longer or shorter sides of the base member 1, they are preferably provided along the shorter sides of the base member 1 so that the left- and right-hand arm members 7 can be folded up without interferring with each other when the lighter 10 is used by itself since the arm members 7 are required to have a length sufficient to hold the cigarette package 21 therebetween.

Figure 4:
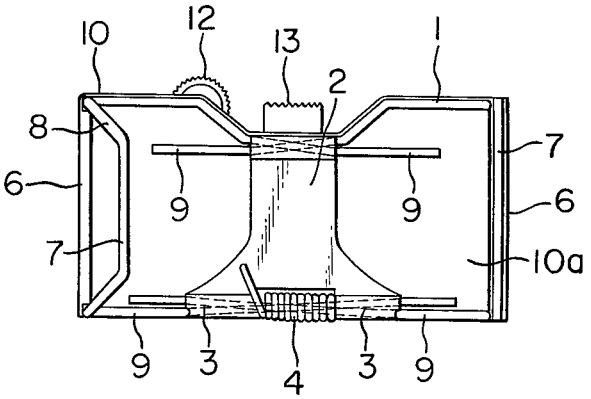
FIG. 4 is a bottom view of an alternative embodiment of a lighter device in accordance with the present invention.
Figure 5:
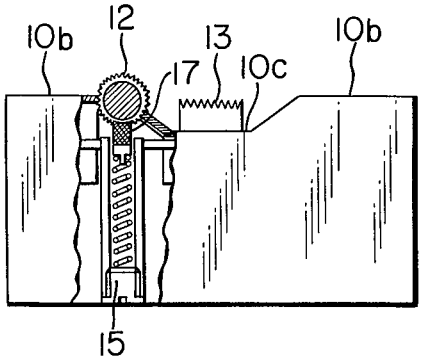
FIG. 5 is a schematic bottom view, partially broken away, of the inventive lighter device.

FIG. 4 is a bottom view showing an alternative embodiment of the present invention wherein the arm members 7 are adapted to be arranged with variable distances. Since cigarette packages are not always equal in width (although normally substantially equal in depth), and since it becomes difficult for the holder to positively hold the cigarette package by the force of the spring members 8 when the number of cigarettes 23 contained in the cigarette package 21 is reduced, it is preferable to design the arm members 7 to be movable so as to provide variable distances therebetween. This is acomplished by fabricating the base member 1 of two U-shaped frames 9 arranged in an elongated tetragon shape which are slidable with respect to the reinforcing plate 2.

With this arrangement, the length of the longer sides of the base member can be made variable and a desired length can be maintained constant by frictional forces caused between the U-shaped frames 9 and the reinforcing plate 2. If increased frictional forces are desired to maintain the length of the longer sides of the base member constant, a click portion may be provided which is engaged with both of the frames 9 and the reinforcing plate 2. Since this arrangement permits expansion and contraction of the base member 1, the arm members 7 can be folded up without interferring with each other when the lighter 10 is used by itself, even if the arm members 7 are relatively long.

As described above, there has been provided in accordance with the present invention, a lighter device useful by itself as a lighter or in combination with a cigarette package. The cigarette package holder portion of the lighter device provides effective protection for a soft cigarette package and cigarettes contained therein from damage and deterioration due to external forces.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A combined lighter and cigarette package holder device comprising a base member contoured in a substantial tetragon shape, a lighter portion contoured in a substantial flat parallelopipedon shape and having one ridgeline hingingly attached to one side of one surface of the base member such that it can rotate between a first position where it is placed on the base member and a second position where it is placed perpendicularly with respect to the base member, spring means for urging the lighter portion towards the first position, at least one arm member hinged to each of the opposite sides of the base member which are perpendicular to the side thereof to which the lighter is hinged such that each of the arm members can rotate between a first position where it is placed adjacent the base member and a second position where it is placed perpendicularly to the base member, spring means for urging the arm members toward the first position, and the lighter portion including a gas ejection nozzle, a flint for igniting the gas ejected through the nozzle, an operation wheel for rotating a file in sliding contact with the flint and having at least a part projecting from a surface of the lighter portion, and a valve-opening button normally closing a valve for the nozzle and opening the valve when depressed.

2. A combined lighter and cigarette package holder device as set forth in claim 1, wherein the base member and the arm members are made of metal hard wires bent in elongated tetragon shape.

3. A combined lighter and cigarette package holder device as set forth in claim 2, which further comprises a reinforcing plate extending between the center portions of the longer sides of the base member.

4. A combined lighter and cigarette package holder device as set forth in claim 3, wherein the base member is composed of two U-shaped metal hard wires slidable with respect to the reinforcing plate so that the arm members can be inserted between the inner and outer wrappers of a cigarette package to be held regardless of the width of the cigarette package and wherein the lighter portion is hinged along the longer side of the base member.

5. A combined lighter and cigarette package holder device as set forth in claim 1, wherein the base member is in the form of a plate.

6. A combined lighter and cigarette package holder device as set forth in claim 5, wherein an opening is formed in the base plate to allow the smoker to take out cigarettes there-through from a cigarette package when a cigarette package is held between the arm members.

7. The combined lighter and cigarette package holder device as set forth in claim 5, wherein the base member is formed of a synthetic resin.

8. The combined lighter and cigarette package holder device as set forth in claim 5, wherein the base member is formed of metal.

9. The combined lighter and cigarette package holder device as set forth in claim 1, wherein the arm members are formed of synthetic resin plates.

10. The combined lighter and cigarette package holder device as set forth in claim 1, wherein the arm members are formed of metal plates.

* * * * *

UNITED STATES PATENT OFFICE
CERTIFICATE OF CORRECTION

PATENT NO. : 4,223,784

DATED September 23, 1980

INVENTOR(S) : Masao Kaneyasu

It is certified that error appears in the above-identified patent and that said Letters Patent are hereby corrected as shown below:

[30] FOREIGN APPLICATION PRIORITY DATA

October 13, 1978 Japan.....53/139634

Signed and Sealed this

*Third* Day of *March 1981*

[SEAL]

*Attest:*

RENE D. TEGTMEYER

*Attesting Officer* *Acting Commissioner of Patents and Trademarks*